US005752422A

United States Patent [19]

Inoue et al.

[11] Patent Number: 5,752,422

[45] Date of Patent: May 19, 1998

[54] DESK-TOP CIRCULAR SAW WITH AN AUXILLIARY GUIDE FENCE

[75] Inventors: Nobuhiro Inoue; Toshiyuki Kani, both of Anjo, Japan

[73] Assignee: Makita Corporation, Japan

[21] Appl. No.: 725,569

[22] Filed: Oct. 3, 1996

[30] Foreign Application Priority Data

Oct. 4, 1995 [JP] Japan ..... 7-257829

[51] Int. Cl.[6] ..... B27B 5/26

[52] U.S. Cl. ..... 83/468.3; 83/471.3; 83/477.2; 83/581

[58] Field of Search ..... 83/468.3, 497, 83/471.3, 477.2, 478, 490, DIG. 1, 581; 144/253.1, 287

[56] References Cited

U.S. PATENT DOCUMENTS

| | | | |
|---|---|---|---|
| 4,556,094 | 12/1985 | Willocks | 83/471.3 |
| 4,600,184 | 7/1986 | Ashworth | 269/303 |
| 4,638,700 | 1/1987 | Fushiya et al. | 83/471.3 |
| 5,181,448 | 1/1993 | Terpstra | 83/468.3 |
| 5,297,463 | 3/1994 | O'Banion et al. | 83/468.3 |
| 5,325,900 | 7/1994 | Garuglieri et al. | 144/253 |
| 5,564,323 | 10/1996 | Sasaki et al. | 83/471.3 |

*Primary Examiner*—Maurina T. Rachuba
*Attorney, Agent, or Firm*—Lahive & Cockfield, LLP

[57] ABSTRACT

A desk-top circular saw has a main fence mounted on a turntable. The main fence has right and left fence sections and a curved section connecting the two fence sections. The fence sections are bolted down to respective side portions of a base. The fence sections have right and left main guide surfaces disposed at right angles relative to the top surface of the turntable. The right main guide surface has approximately a rectangular shape while the left main guide surface has a portion cut in two steps descending toward a blade slit in order to avoid interference with the locus of the saw blade assembly when tilted. An auxiliary fence is pivotally attached to the rear side of the left fence section. The auxiliary fence includes an auxiliary guide surface located on the same plane as the left main guide surface and a slide portion set backward off the aforementioned plane so as to be slidable with the rear surface of the left fence section in pivoting. In vertical cutting, the auxiliary fence is pivoted to the inside, right position. In angular cutting, the auxiliary fence is pivoted to the outside, left position. In either case, the auxiliary guide surface provides additional coplanar support for the work piece.

7 Claims, 6 Drawing Sheets

DESK-TOP CIRCULAR SAW WITH AN AUXILLIARY GUIDE FENCE

BACKGROUND OF THE INVENTION

1. Field of the Invention

The present invention relates to a desk-top circular saw. More particularly, the present Invention relates to a desk-top circular saw including a table on which a work piece is placed and a fence structure for supporting a work piece during operation.

2. Description of the Prior Art

FIG. 6 of the attached drawings shows a conventional desk-top circular saw 30 in which a turntable 32 has an arm 33 provided upright thereon. The turntable 32 is in turn mounted on a base 31. The desk-top circular saw 30 also includes a left fence 35 with a guide surface 36 provided upright on the top surface of the turntable 32. During operation, a work piece W is held against the guide surface 36 for securing the position thereof.

The conventional desk-top circular saw 30 can also perform angular or bevel cutting by titling the arm 33 and the saw blade assembly 34 as shown in FIG. 7. A portion of the fence 35 is cut to avoid interference with the saw blade assembly 34 and the saw blade 37 when they are tilted. This configuration, however, decreases the guide surface 36 and thus the support provided for the work piece W, thereby adversely affecting the accuracy of cutting.

SUMMARY OF THE INVENTION

It is an object of the present invention to provide a desk-top circular saw with an angular cutting feature that can provide sufficient support for the work piece.

The above and other related objects are attained by a desk-top circular saw which comprises a table on which a work piece is placed and a saw blade assembly including a motor-driven circular saw blade. The saw blade assembly is attached to the table such that the assembly can be tilted to a desired angle in the direction orthogonal to the side faces of the saw blade to perform angular cutting. The desk-top circular saw further comprises a main fence including at least one main guide surface for being abutted on by and supporting a work piece during cutting. The main fence has a portion cut so as to avoid interference with the locus of the saw blade assembly when the assembly is tilted. The desk-top circular saw further comprises an auxiliary fence having an auxiliary guide surface movable between a first position in which the auxiliary guide surface is located on the part of the plane substantially corresponding to the cut portion and a second position in which the auxiliary guide surface is not located on the part of the plane substantially corresponding to the cut portion.

Preferably, when the auxiliary guide surface of the auxiliary fence is in the second position, the auxiliary guide surface is located flush with the at least one main guide surface of the main fence.

According to one aspect of the present invention, the auxiliary fence may be pivotal on an axis to move between the two positions.

In carrying out the invention in one preferred mode, the lower edge of the auxiliary guide surface is located at approximately the same height as the surface of the table on which a work piece is placed when the auxiliary fence is in the second position.

In a further aspect of the Invention, the auxiliary guide surface is at least as high as the main guide surface of the main fence when the auxiliary fence is in the second position.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

Figure 1:
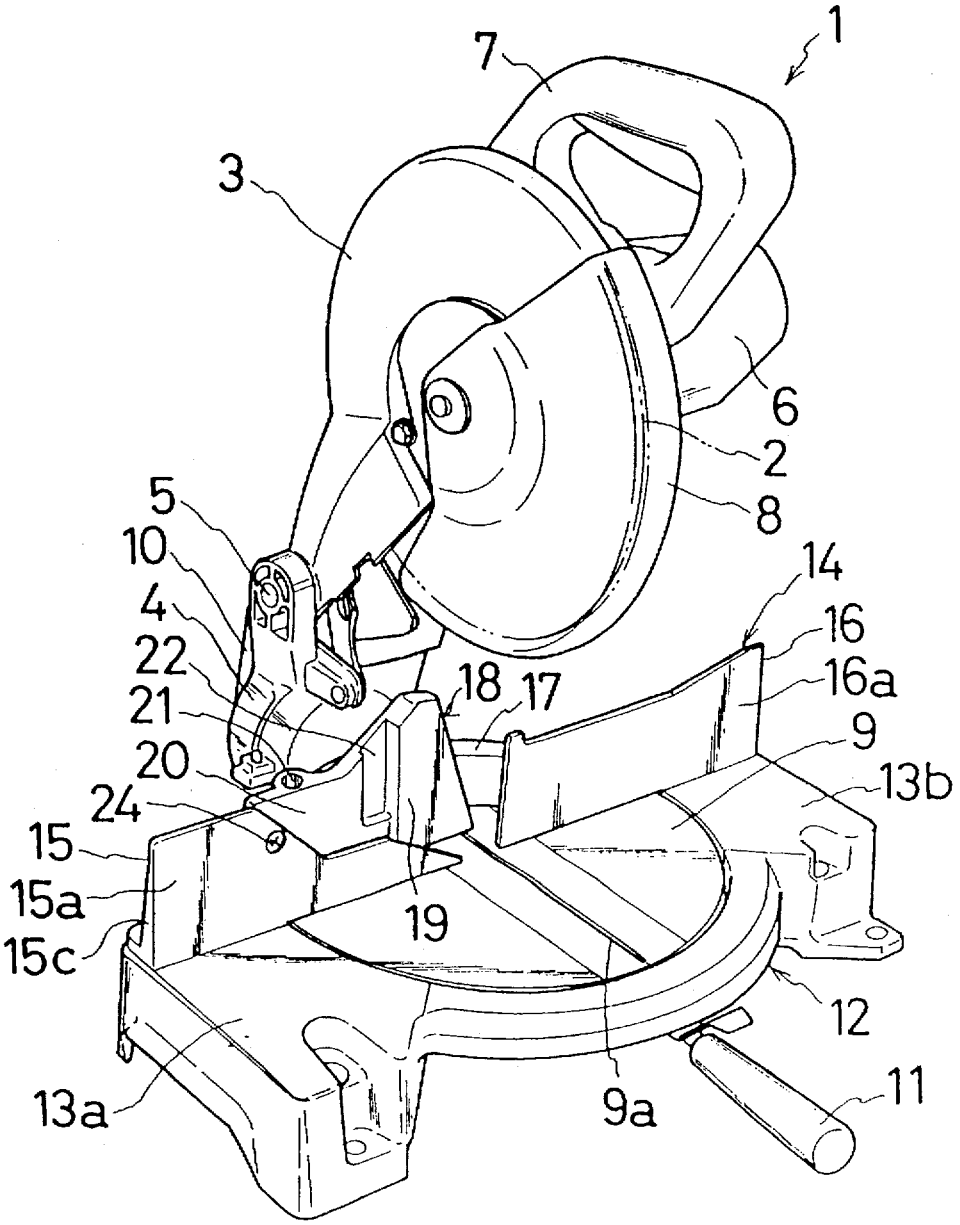
FIG. 1 is a perspective view of a desk-top circular saw in accordance with the present invention.

Referring first to FIG. 1, reference numeral 1 designates a desk-top circular saw which includes a saw blade assembly 3 provided with a saw blade 2 rotatably driven by a motor 6. The saw blade assembly 3 is pivotally supported at the top end of an arm 4 by a shaft 5 and urged to the illustrated position by a compression spring (not shown). Reference numerals 7 and 8 designates a top handle and a blade guard, respectively. The arm 4 is pivotally attached to the rear end of a turntable 9 such that the arm 4 and the saw blade assembly 3 can be tilted to the left and locked at a desired angle. (The side where the arm 4 is located is referred to as the rear and the opposite side the front hereinafter. Also, the left side as in FIG. 1 is referred to as the left hereinafter.) This tilting and locking is performed with a lock lever 10 provided at the rear of the arm 4. Furthermore, the turntable 9 is horizontally rotatably mounted on a base 12, so that the turntable 9 can be rotated with a table handle 11 projecting from under the base 12.

With this construction, the desk-top circular saw 1 can perform angular cutting by tilting the arm 4 and the saw blade assembly 3 sideways. Moreover, the arm 4 and the saw blade assembly 3 can be rotated relative to the base 12 using the table handle 11 to adjust the horizontal cutting angle of a work piece placed on the turntable 9.

Figure 4:
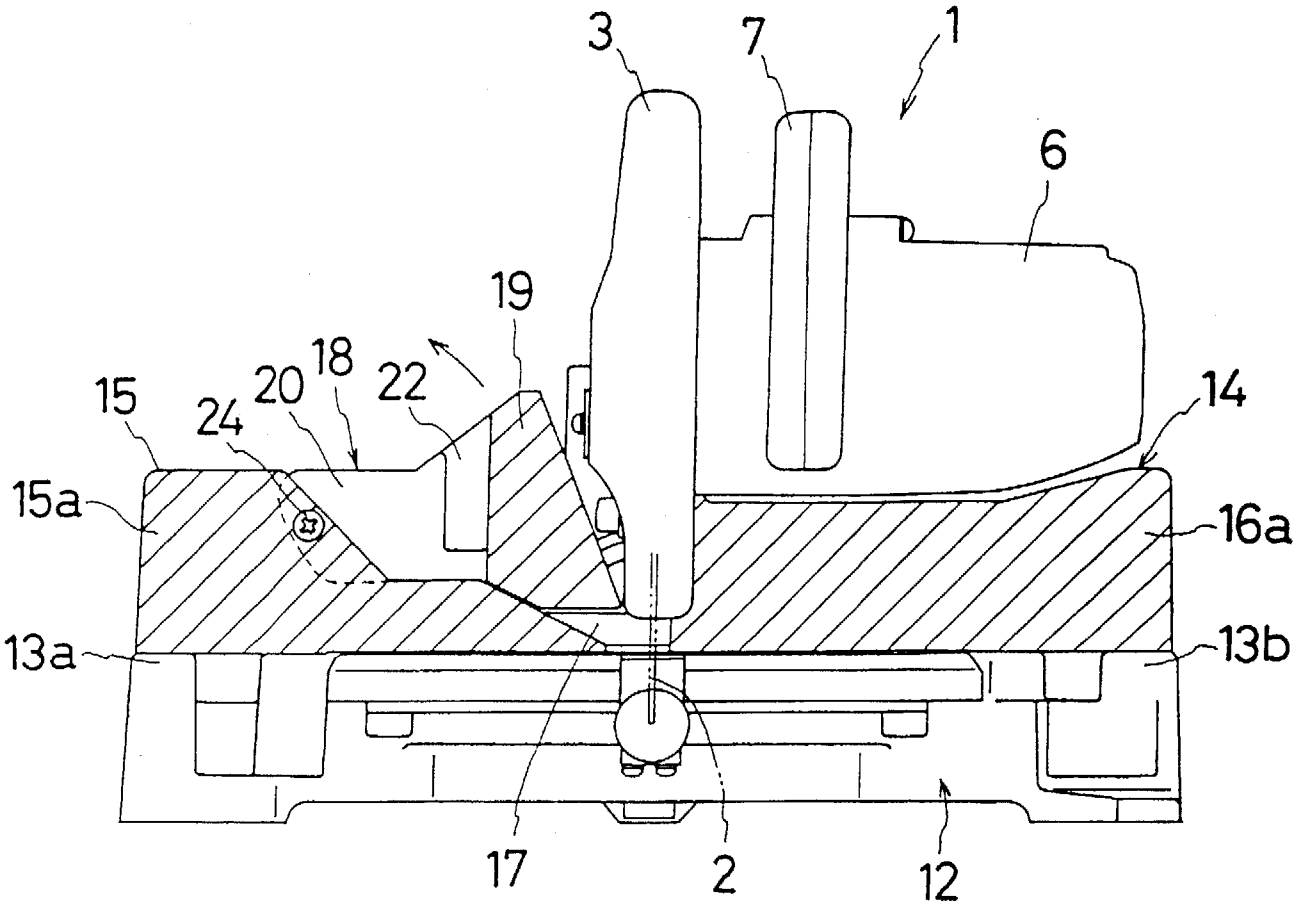
FIG. 4 is an elevational view of the desk-top circular saw with the auxiliary fence in the inside position.
Figure 5:
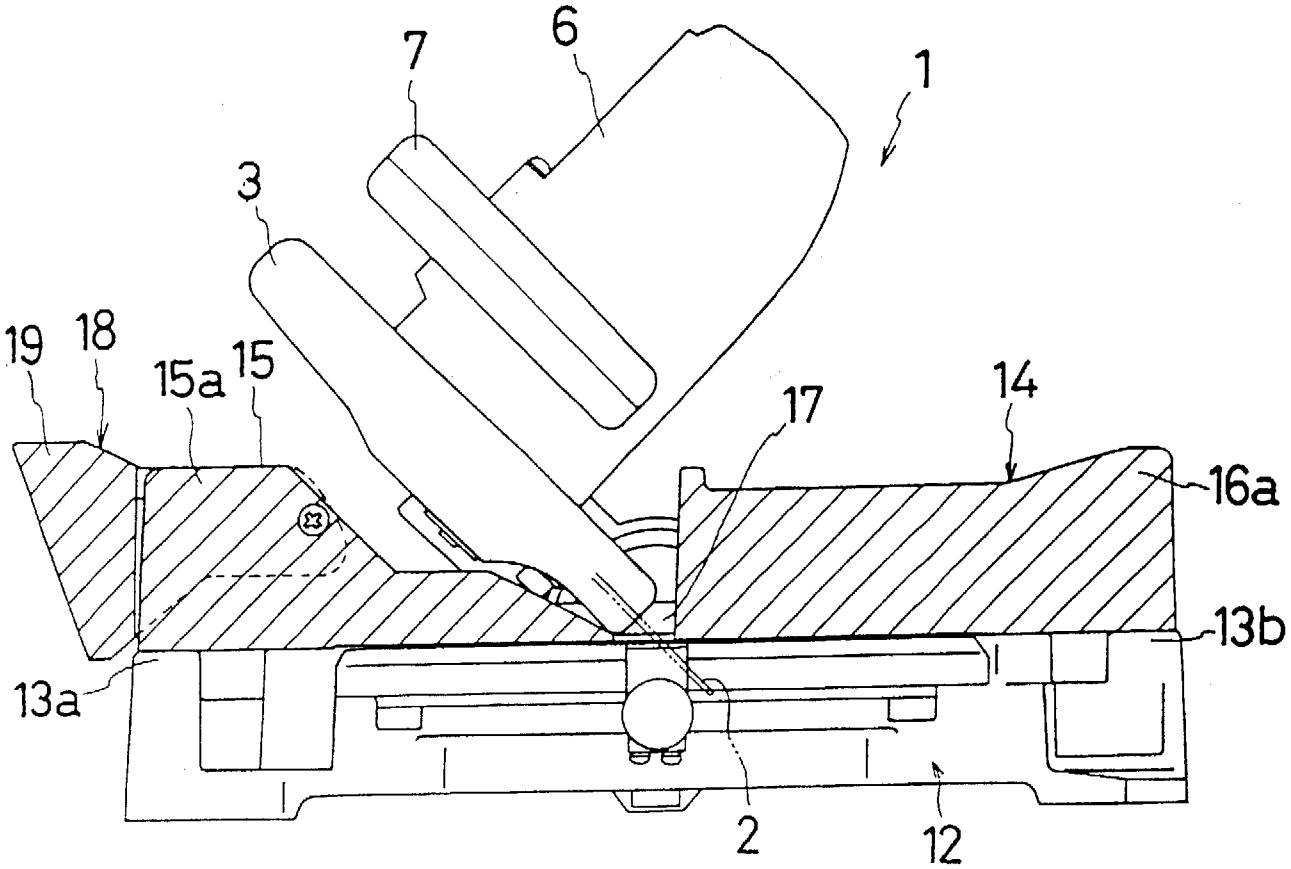
FIG. 5 is an elevational view of the desk-top circular saw with the auxiliary fence in the outside position.
Figure 6:
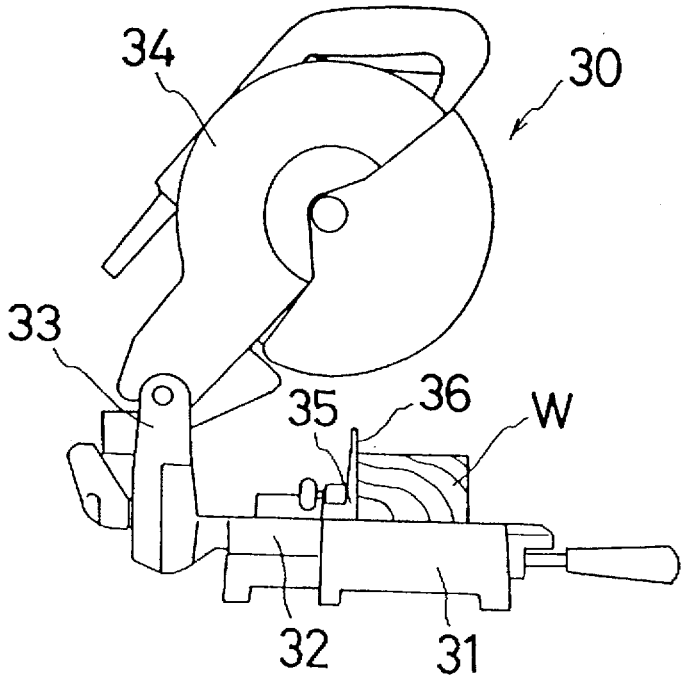
Fig 6 (PRIOR ART)
FIG. 6 is a side elevational view of a conventional desk-top circular saw.
Figure 7:
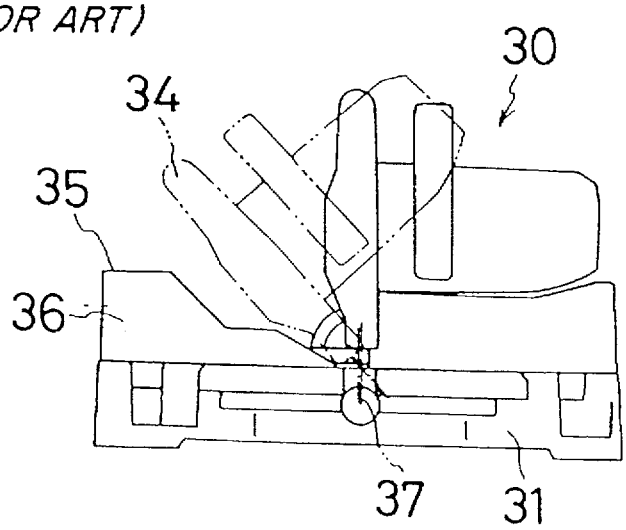
Fig 7 (PRIOR ART)
FIG. 7 is an elevational view of the conventional desk-top circular saw of FIG. 6, showing the saw blade assembly in two positions.

Provided on the turntable 9 is a main fence 14 including right and left fence sections 16 and 15, respectively, and a curved section 17 connecting the fence sections 16 and 15. The curved section 17 is so shaped as to circumvent a blade slit **9*a* provided in the turntable 9. The right and left fence sections 16 and 15 are bolted down to right and left side portions 13*a* and 13*b* of the base 12. The top surfaces of the side portions 13*a* and 13*b* are coplanar with that of the turntable 9. The right and left fence sections 16 and 15 have right and left main guide surfaces 16*a* and 15*a*, respectively, disposed at right angles relative to the top surface of the turntable 9. The right main guide surface 16*a* has approximately a rectangular shape as best shown in FIGS. 4 and 5. On the other hand, the left main guide surface 15*a* has a portion cut along two slopes descending toward the blade slit 9*a* and a horizontal line between the slopes in order to avoid interference with the locus of the saw blade assembly 3** when it is tilted.

Figure 2:
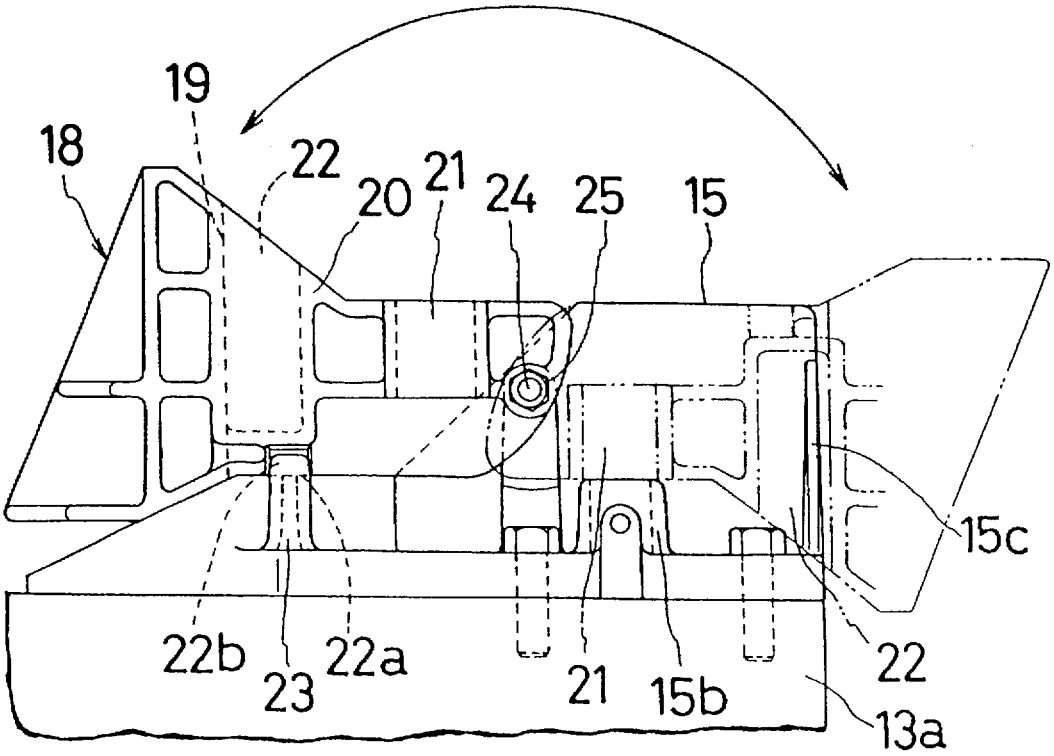
FIG. 2 is a rear elevational view of the auxiliary fence of the desk-top circular saw of FIG. 1.
Figure 3:
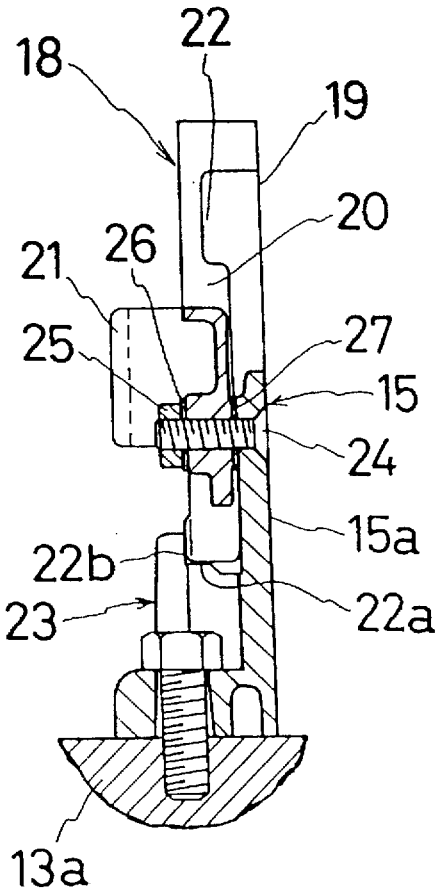
FIG. 3 is a partially sectional view of the auxiliary fence as attached to a left main fence section.

An auxiliary fence 18 is pivotally attached to the side of the left fence section 15 opposite to the guide surface 15*a* with a screw 24, a nut 25, and washers 26 and 27 as shown in FIGS. 2 and 3. The auxiliary fence 18 includes an auxiliary guide surface 19 located on the same plane as the main guide surface 15*a* and a slide portion 20 set backward off the aforementioned plane so as to be slidable with the rear surface of the left fence section 15 when pivoting. The slide portion 20 in turn includes a hollow cylindrical portion 21 and a recess 22. The hollow of the cylindrical portion 21 is disposed over, and axially aligned with, a through hole 15*b* to receive a vertical bar of a vise (not shown) when rotated to the outside, left position as shown in FIG. 2. On the other hand, the recess 22 is provided to avoid interference with a rib 15*c* formed on the left fence section 15 when pivoted to the outside position. When the auxiliary fence 18 is rotated to the outside position, the auxiliary guide surface 19 is slightly higher than the main guide surface 15*a* as shown in FIG. 5. Also, when the auxiliary fence 18 is in this position, the lower edge of the auxiliary guide surface 19 is located at substantially the same height as the top surfaces of the turntable 9 and the right and left side portions 13*a* and 13*b* of the base 12.

Also, a stopper 23 is projected upright from the fence section 15 close to its connection to the curved section 17. The stopper 23 has a horizontal surface 22*a* located on the same plane as the horizontal edge between the two slopes of the fence section 15. The stopper 23 also includes a vertical face 22*b* connected to the horizontal surface 22*a*.

In the desk-top circular saw 1, thus constructed, the auxiliary fence 18 is normally pivoted to tile inside, right position when performing vertical cutting. In this position, the horizontal surface 22*a* of the stopper 23 abuts on one of the horizontal edges of the slide portion 20 as shown in FIG. 2. When the auxiliary fence 18 is in this position, the auxiliary guide surface 19 provides additional support for a work piece as best shown in FIG. 4 so that the work piece can be handled in a more stable manner, thus increasing the accuracy of cutting. (In FIGS. 4 and 5, the coplanar guide surfaces, which contact the work piece, are marked with hatching.) In this position, the auxiliary fence 18 is prohibited from moving backward by the vertical face 22*b* of the stopper 23 provided behind the slide portion 20.

To perform angular cutting, the auxiliary fence 18 is pivoted to the outside, left position, in which the opposite side edge of the slide portion 20 comes into abutment with the lip of the through hole 15*b* as shown in FIG. 2. In this position the auxiliary guide surface 19 extends outwardly from the left main guide surface 15*a* on the same plane as shown in FIG. 5, adding additional coplanar support for increased and more stable angular cutting. The same additional support is available when the turntable 9 is rotated to change the horizontal cutting angle As described before, the auxiliary guide surface 19 is slightly higher than the main guide surface 15*a* when the auxiliary fence 18 is rotated to the outside position. Therefore, the guide surface 19 can provide support at least in the same vertical range as the main guide surface 15*a* of the fence section 15, thereby increasing the effective guide surfaces.

Furthermore, since the lower edge of the auxiliary guide surface 19 is at approximately the same height as, and substantially coplanar with, the top surfaces of the turntable 3 and the right and left side portions 13*a* and 13*b* of the base 12 when the auxiliary fence 18 is in the outside position, even a long, thin work piece can be securely guided and supported.

As is clearly seen from the foregoing, the auxiliary fence 18, pivotal between the two positions, can always provide a large support surface regardless of the manner of cutting, thereby contributing to increased stability and accuracy of cut.

As there may be many other modifications, alterations, and changes without departing from the scope or spirit of the essential characteristics of the present invention, it is to be understood that the above embodiment is only illustrative and not restrictive in any sense. The scope or spirit of the present invention is limited only by the terms of the appended claims.

As an example of such modifications, the auxiliary fence 18, although pivotal between the two positions in the foregoing embodiment, may be configured to slide horizontally between the two positions or to slide vertically. Alternatively, the auxiliary fence 18 may be either accommodated inside the left main fence section 15 or simply moved behind the section 15 when the saw blade assembly 3 is tilted, instead of being pivoted to the outside position as in the embodiment.

Furthermore, the auxiliary fence 18 may be provided on the right side or both sides of the saw blade assembly 3 to suit particular applications.

What is claimed is:

1. A desk-top circular saw having a table on which a work piece is placed, a saw blade assembly including a motor-driven circular saw blade, the saw blade assembly being attached to the table such that the assembly can be tilted to a desired angle in a direction orthogonal to the side faces of the saw blade to perform angular cutting, and a main fence including at least one main guide surface for supporting a work piece during cutting, the main fence having a portion so cut as to avoid interference with the locus of the saw blade assembly when the assembly is tilted, the desk-top circular saw further comprising an auxiliary fence having a pivotally-mounted auxiliary guide surface pivotal between a first position in which the auxiliary guide surface is located on the part of the plane substantially corresponding to the cut portion and a second position in which the auxiliary guide surface is not located on the part of the plane substantially corresponding to the cut portion.

2. A desk-top circular saw in accordance with claim 1, wherein, in the second position, the auxiliary guide surface of the auxiliary fence is located flush with the at least one main guide surface of the main fence.

3. A desk-top circular saw in accordance with claim 2 wherein, when the auxiliary fence is in the second position, the lower edge of the auxiliary guide surface is located at approximately the same height as the surface of the table on which a work piece is placed.

4. A desk-top circular saw in accordance with claim 2 wherein the auxiliary guide is at least as high as the main guide surface of the main fence when the auxiliary fence is in the second position.

5. A desk-top circular saw in accordance with claim 1 wherein, when the auxiliary fence is in the second position, the lower edge of the auxiliary guide surface is located at approximately the same height as the surface of the table on which a work piece is placed.

6. A desk-top circular saw in accordance with claim 1 wherein the auxiliary guide is at least as high as the main guide surface of the main fence when the auxiliary fence is in the second position.

7. A desk-top circular saw in accordance with claim 3 wherein the auxiliary guide is at least as high as the main guide surface of the main fence when the auxiliary fence is in the second position.

* * * * *